US008100508B2

(12) United States Patent
Saito et al.

(10) Patent No.: US 8,100,508 B2
(45) Date of Patent: Jan. 24, 2012

(54) INK JET PRINTING HEAD

(75) Inventors: Riichi Saito, Fujisawa (JP); Yasutomo Watanabe, Hiratsuka (JP); Akira Yamamoto, Yokohama (JP); Shuzo Iwanaga, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 348 days.

(21) Appl. No.: 12/138,176

(22) Filed: Jun. 12, 2008

(65) Prior Publication Data

US 2008/0309731 A1 Dec. 18, 2008

(30) Foreign Application Priority Data

Jun. 15, 2007 (JP) ..... 2007-159293

(51) Int. Cl.
*B41J 2/16* (2006.01)

(52) U.S. Cl. ..... 347/50; 347/59; 347/57; 347/56

(58) Field of Classification Search ..... 347/56–59, 347/61, 63, 65, 50
See application file for complete search history.

(56) References Cited

U.S. PATENT DOCUMENTS

| | | | | |
|---|---|---|---|---|
| 6,412,918 | B1 * | 7/2002 | Chen et al. | 347/56 |
| 6,543,880 | B1 * | 4/2003 | Akhavain et al. | 347/42 |
| 7,681,987 | B2 * | 3/2010 | Tobita et al. | 347/47 |
| 2003/0085957 | A1 * | 5/2003 | Huang et al. | 347/63 |
| 2006/0023030 | A1 * | 2/2006 | Kaneko | 347/55 |
| 2006/0221137 | A1 * | 10/2006 | Silverbrook et al. | 347/56 |
| 2006/0244787 | A1 * | 11/2006 | Enomoto et al. | 347/63 |

FOREIGN PATENT DOCUMENTS

JP 2004-351931 A 12/2004

* cited by examiner

*Primary Examiner* — Matthew Luu
*Assistant Examiner* — Henok Legesse
(74) *Attorney, Agent, or Firm* — Canon USA Inc IP Division

(57) ABSTRACT

A printing head is provided in which a distance between an ejection port face of the printing head and a print medium is reduced to improve an ink ejection accuracy during a printing operation. The printing head of the present invention is a back shooting-type printing head. The heater and an electrode connected thereto are formed at the back face of the substrate. The electrode and an in-support-base wiring for supplying electricity to the heater via the electrode are connected to each other at the back face side of the substrate. The substrate and the support base have therebetween a liquid chamber wall member including therein a space. The substrate, the support base, and the liquid chamber wall member constitute a liquid chamber that communicates with the ejection port and that stores ink supplied to the ejection port.

7 Claims, 11 Drawing Sheets

INK JET PRINTING HEAD

BACKGROUND OF THE INVENTION

1. Field of the Invention

The present invention relates to a so-called back shooting-type ink jet printing head in which droplets are ejected in a direction opposite to a direction along which bubbles grow.

2. Description of the Related Art

An ink jet printing head mounted on an ink jet printing apparatus is structured so that minute ink droplets are ejected through minute ejection ports to perform a printing operation onto a print medium. A printing head using an electrothermal transducing element (heater) as an ink ejection energy generation means causes ink surrounding the heater to be heated within a short time in order to eject ink droplets. Bubbles are generated in ink that is filled in the interior of a liquid chamber of the printing head. Then, the generated bubbles are caused to expand to apply a pressure to the ink filled in the liquid chamber. As a result, the ink in the vicinity of the ejection port is caused to pass an ejection port and is ejected in the form of droplets. Methods for ejecting ink by a printing head may be classified depending on the relation between a bubble growth direction and an ink ejected direction. According to the back shooting method as an ink ejecting method, a direction along which bubbles grow is opposite to a direction along which droplets are ejected.

Such ink jet printing apparatus of the back shooting type is proposed by for example Japanese Patent Laid-Open No. 2004-351931. Japanese Patent Laid-Open No. 2004-351931 discloses a plate including an ejection port that includes a relatively-thick heat diffusion layer that is a layer at the surface opposed to a print medium. Thus, the ejection port has a sufficient length so that accuracy of ink ejection through the ejection port is improved.

FIG. 11 shows an example of a conventional printing head using the back shooting method. FIG. 11 is a cross-sectional view illustrating the structure of a printing head when Tape Automated Bonding (TAB) is used to install an electrical wiring portion on a substrate. At the surface of a silicon substrate 100 in the printing head, a liquid path having a predetermined depth forms a liquid chamber 106 when the silicon substrate 100 is joined with an orifice plate 130 (which will be described later). The liquid chamber 106 is filled with ink to be ejected through the printing head. The back face side includes an ink supply port 102 for supplying ink to the liquid chamber 106.

The upper part of the silicon substrate 100 is joined with an orifice plate 130. The orifice plate 130 is joined with the silicon substrate to form an upper wall of the liquid chamber 106. This orifice plate 130 includes a plurality of ejection ports 104 for ejecting ink from the liquid chamber 106. The ejection ports are arranged in two columns so as to penetrate the orifice plate 130 in the thickness direction. The orifice plate 130 consists of a plurality of layers layered on the silicon substrate 100. Among these layers, heaters 108 are arranged. The heaters 108 are electrically connected by a conductor 112 to a bonding pad 101.

The bonding pad 101 is electrically connected via a bump 121 to an inner lead 120 formed in the printing apparatus-side by the TAB. Such an electrical connection part is covered by sealant 124 in order to protect this part from an external environment. The sealant 124 is formed to have a convex shape at the periphery of the bonding pad 101. Thus, the sealant 124 protrudes from an ejection port formation surface of the orifice plate 130. A support base 123 is the support base of the printing head.

The following section will describe a mechanism through which the printing head using the back shooting method as described above is used to eject ink through the ejection port 104.

First, pulsed current is applied to the heater 108 via the conductor 112 while the liquid chamber 106 and the ejection port 104 are being filled with ink. The electric energy is transduced to thermal energy and the heater 108 generates heat. The heat generated by the heater 108 is used to heat the ink on the heater 108. When the temperature of heated ink exceeds the boiling point, the ink on the heater 108 boils to generate bubbles. Continuous heat supply causes the generated bubbles to grow from the heater 108 and toward the lower side in FIG. 11. As a result, a part of the ink surrounding the ejection port 104 is extruded from the ejection port 104 to the upper side in FIG. 11. In this manner, the ink stored in the liquid chamber 106 is ejected in the form of droplets in a direction opposite to a direction along which bubbles grow (a direction toward the print medium).

When the current applied to the heater 108 is blocked, bubbles contract and finally disappear. With the contraction of bubbles, ink is supplied from the ink supply port 102 via an ink flow path 105 into the liquid chamber 106 to fill ink in the liquid chamber 106 again. When the ink refill process is completed to return to an initial state, the steps as described above are repeated. In this manner, ink is continuously ejected through the ejection port 104.

In order to maintain a high-quality printing by the printing head as described above, it is required that a high accuracy of ejection is secured during the ejection of droplets. In order to secure a high ejection accuracy of droplets, it is effective to minimize the distance between an ejection port face and a print medium.

In the case of the conventional back shooting-type ink jet printing head as shown in FIG. 11, however, the electrical wiring portion positioned at the obverse face of the orifice plate 130 is covered by the sealant 124, and the sealant 124 protrudes closer to the print medium-side (the upper side in FIG. 11) than the ejection port face of the printing head.

Due to the structure as described above in which the sealant 124 protrudes closer to the print medium than the ejection port face, the ejection port face of the printing head is prevented from approaching the print medium. As a result, the distance between the ejection port face of the printing head and the print medium cannot be sufficiently reduced, making it difficult to keep the ink ejection accuracy high.

Furthermore, in the case of the conventional back shooting-type printing head shown in FIG. 11, the silicon substrate 100 includes the ink supply port 102 formed so that the flow path has a narrower width toward the ejection port. From the ink supply port 102, the liquid chamber 106 is formed to extend toward the ejection port. Thus, the silicon substrate 100 includes therein a space having a complicated shape, thus possibly causing the time for processing this space to be long. This may cause an increased manufacture cost of the printing head.

SUMMARY OF THE INVENTION

The present invention is directed to a printing head that is structured so that the distance between the ejection port face of the printing head and the print medium can be minimized to improve the ink ejection accuracy and the manufacture cost can be reduced.

According to an aspect of the present invention, an ink jet printing head includes a substrate that includes an ejection port penetrating from an obverse face to a back face of the substrate. The substrate also includes, at the back face side, an electrothermal transducing element configured to generate thermal energy used to eject liquid through the ejection port and a conductive material connected to the electrothermal transducing element formed on the back face. The ink jet head also includes a support base that supports the substrate from the back face side, an electrical wiring formed to transmit electricity and to drive the electrothermal transducing element and arranged so that the conductive material and the electrical wiring are connected at the back face side of the substrate, and a liquid chamber wall member that is located between the substrate and the support base and that includes therein a liquid chamber that communicates with the ejection port and adapted to store liquid to be supplied to the ejection port.

According to the present invention, an electric connection portion is positioned in the back side of the substrate, thus reducing a part protruding from the ejection port face. Thus, when this printing head is used to perform a printing operation, the ejection port face of the printing head can be located at a position closer to the print medium. This can improve the accuracy at which droplets are ejected to improve the quality of an image obtained through the printing operation. This also allows the respective members constituting the printing head to include therein spaces having a relatively-simple shape, thus reducing the manufacture cost of the printing head.

Further features of the present invention will become apparent from the following description of exemplary embodiments (with reference to the attached drawings).

DESCRIPTION OF THE EMBODIMENTS

First Embodiment

Hereinafter, the first embodiment of the present invention will be described with reference to the drawings.

Figure 1:
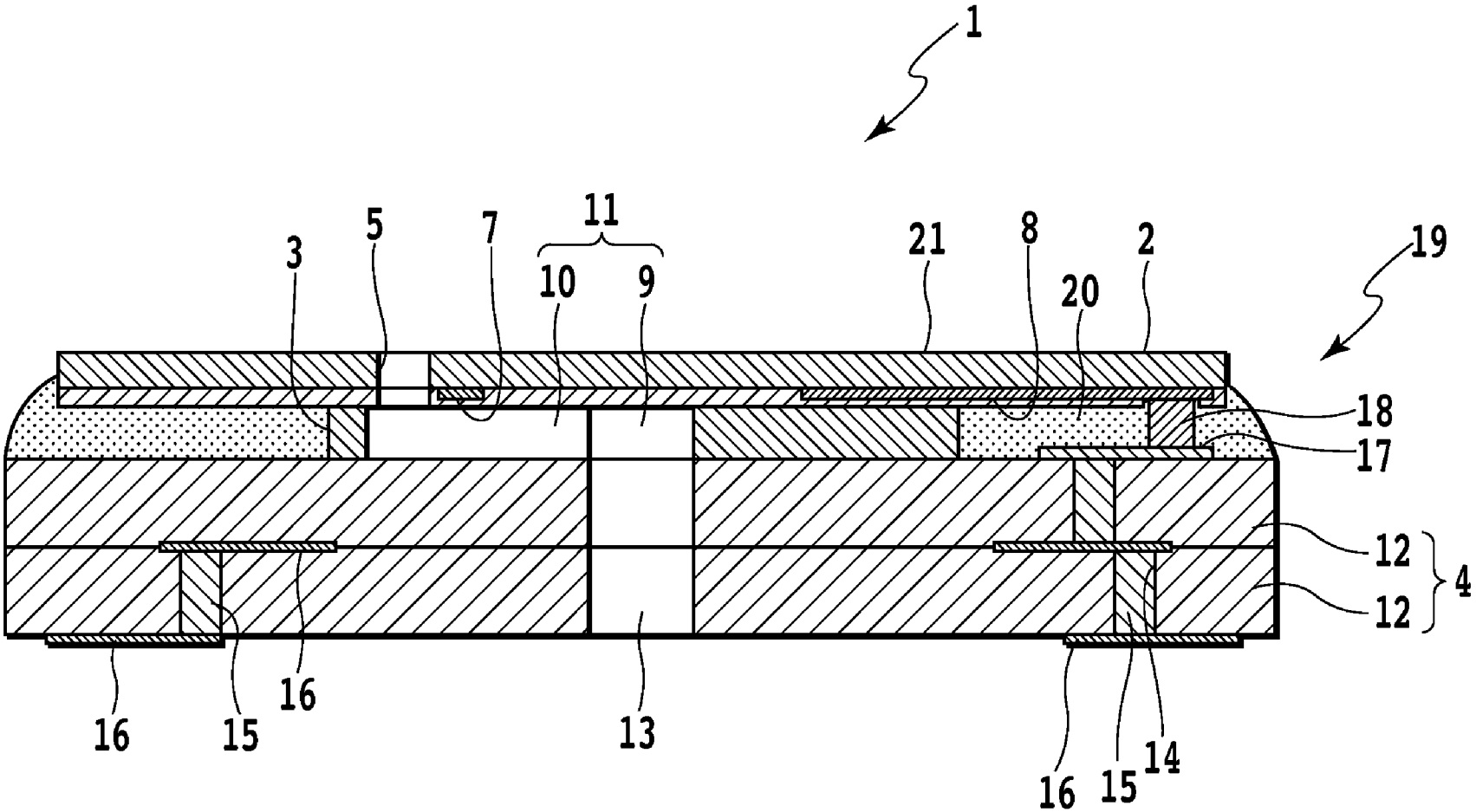
FIG. 1 is a cross-sectional view illustrating a printing head in the first embodiment of the present invention.

FIG. 1 is a cross-sectional view illustrating a back shooting-type printing head 1 according to the present invention. The printing head 1 of this embodiment has a substrate 2, a liquid chamber wall member 3, and a support base 4.

Figure 2:
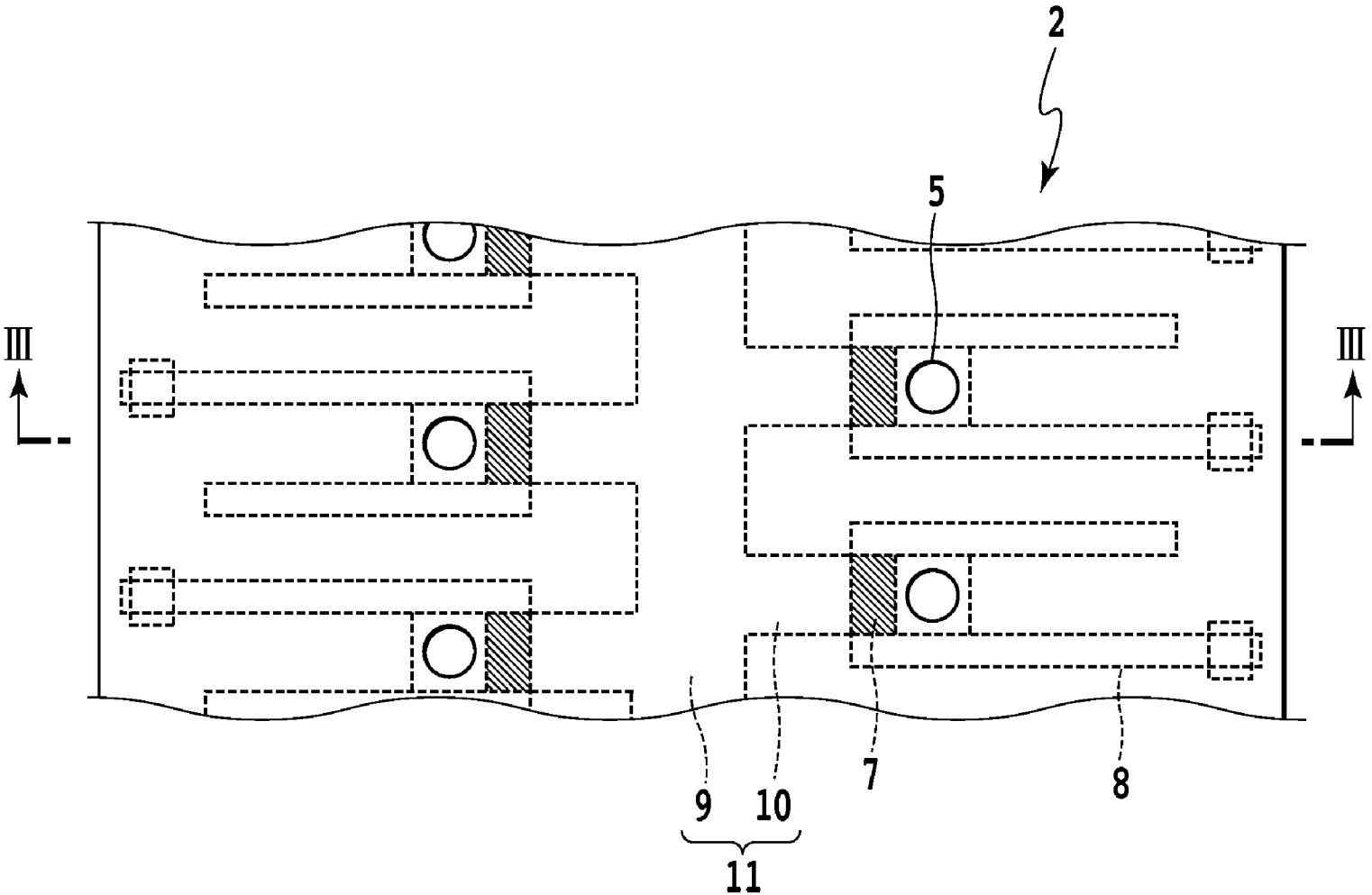
FIG. 2 is a plain view illustrating a substrate and a liquid chamber wall member in the printing head of FIG. 1 seen from the print medium side.
Figure 3:
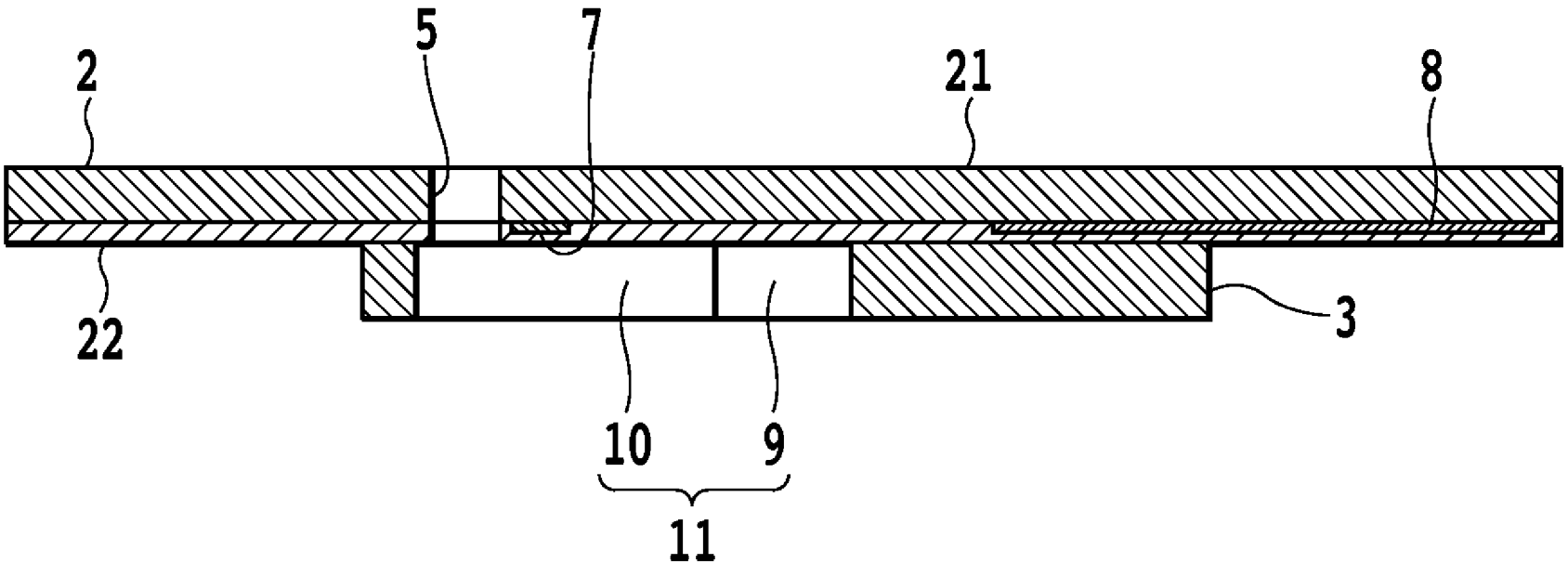
FIG. 3 is a cross-sectional view taken along the line III-III of FIG. 2.

The substrate 2 is made of silicon. A plurality of ejection ports 5 are formed in the substrate 2 so that the ejection port 5 penetrates the substrate 2 from the surface opposed to a print medium to the back face defining a liquid chamber 11 (which will be described later). Thus, the back face of the substrate 2 faces the liquid chamber 11. FIG. 2 is a plain view illustrating the main part of the substrate 2 seen from the print medium side. FIG. 3 is a cross-sectional view taken along the line III-III in FIG. 2. A plurality of ejection ports 5 are arranged in a staggered pattern composed of two columns in this embodiment. At a position of the back face of the substrate 2 in the vicinity of the ejection port 5, a heater 7 as an electrothermal transducing element is arranged to generate thermal energy used to eject ink as liquid through the ejection port 5. Electrodes (conductive material) 8 extending in a direction orthogonal to the direction along which the columns of the ejection ports 5 are arranged are electrically connected to the heater 7 at both sides of the heater 7 in the direction along which the ejection ports 5 are arranged (the up-and-down direction in FIG. 2). A plurality of superposed layers is arranged on the back face of the substrate 2 and they sandwich the heater 7 and the electrode 8.

The liquid chamber wall member 3 includes an ink supply port 9 formed to penetrate therethrough from the obverse face to the back face. The ink supply port 9 extends over the entire range in which the ejection port 5 is formed in a direction along which the ejection ports 5 are arranged. An ink flow path 10 is formed from the ink supply port 9 so that the ink flow path 10 extends to the respective ejection ports 5. The ink supply port 9 and the ink flow path 10 formed by the liquid chamber wall member 3 are also collectively called as the liquid chamber 11. The liquid chamber 11 is a space for storing ink supplied to the ejection port 5. The liquid chamber wall member 3 is made of material that cures when being exposed to light. The liquid chamber wall member 3 in this embodiment is made of photosensitive epoxy resin that cures when being exposed to light.

Figure 4:
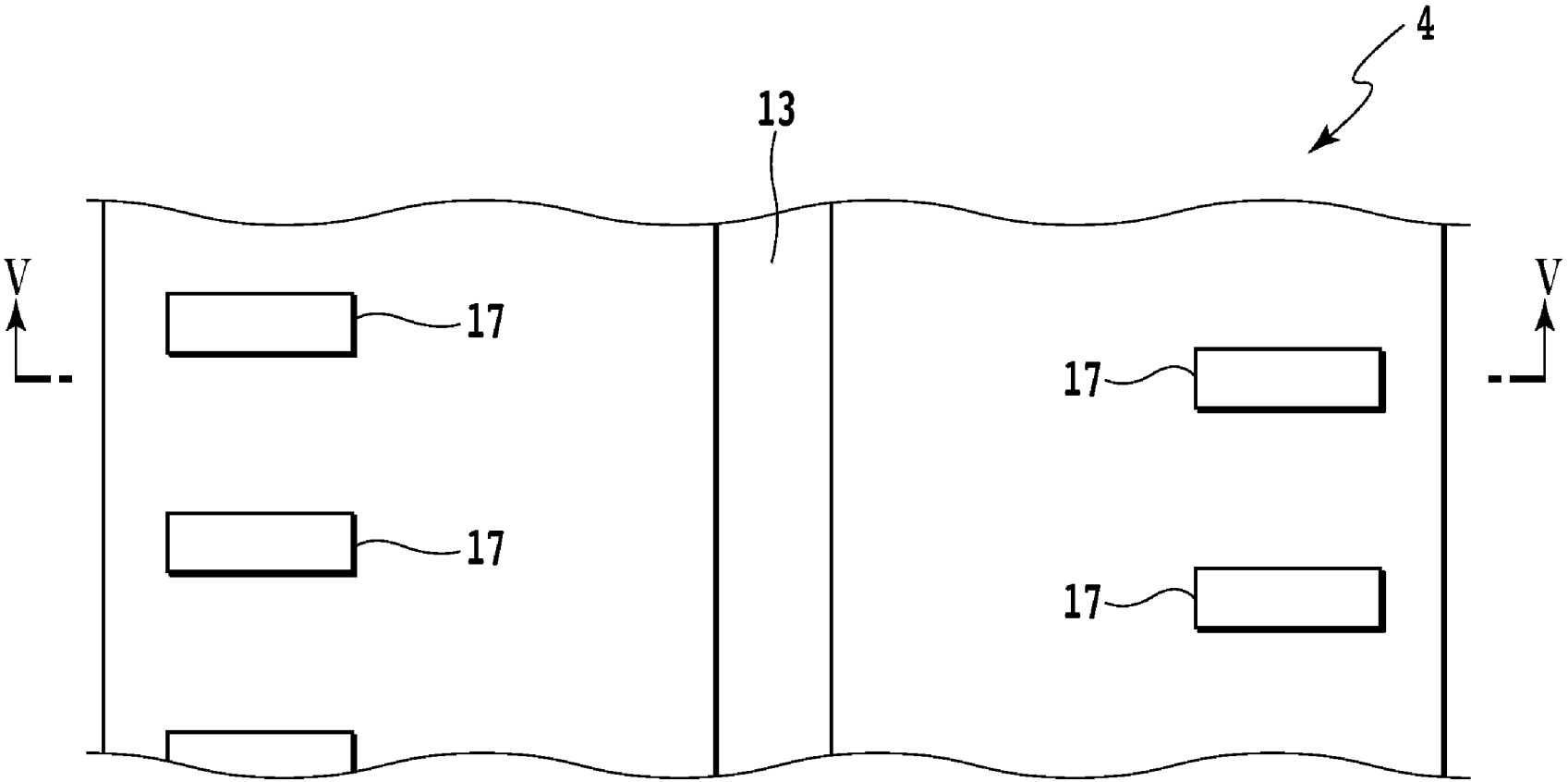
FIG. 4 is a plain view illustrating a support base in the printing head of FIG. 1 seen from the print medium side.
Figure 5:
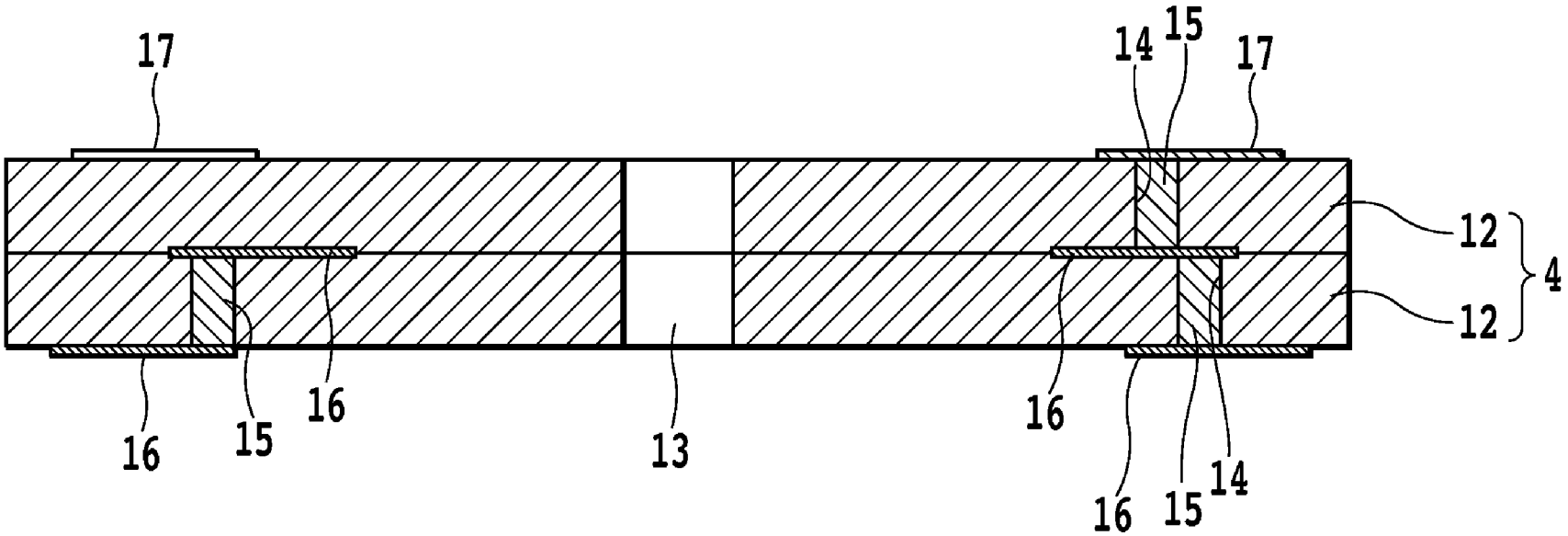
FIG. 5 is a cross-sectional view illustrating the line V-V of FIG. 4.

The support base 4 in this embodiment is formed to have a layered structure obtained by layering a plurality of ceramic sheets 12. FIG. 4 is a plain view illustrating the main part of the support base 4. FIG. 5 is a cross-sectional view taken along the line V-V in FIG. 4. At the center of the ceramic sheet 12 forming the support base 4, an ink channel 13 is formed so as to correspond to the ink supply port 9. The ink channel 13 is formed so as to penetrate the centers of the respective ceramic sheets 12 from the obverse face to the back face. At both sides of the ceramic sheet 12 in a direction orthogonal to the direction along which the ejection ports 5 are arranged (both sides at the left and right in FIG. 4 and FIG. 5), a via hole (also may be called as "through hole") 14 is formed so as to penetrate the ceramic sheet 12 in the thickness direction from the obverse face to the back face. An in-support-base wiring 15 is arranged in the via hole 14. Conductor wirings 16 are arranged among the respective ceramic sheets 12 for connecting the respective in-support-base wirings 15. The electrical wiring of the in-support-base wirings 15 and the conductor wirings 16 provides the input of the driving of the heater 7. In the support base 4, the face joined to the substrate 2 and the liquid chamber wall member 3 (the upper face in FIG. 5) has thereon a connection terminal 17 provided at a position corresponding to the in-support-base wiring 15.

According to the printing head 1 of this embodiment, the support base 4 is formed by adhering a plurality of ceramic sheets 12. Conventionally, a part corresponding to the support base 4 is formed by the silicon substrate 100 as shown in FIG.

11. An ink supply port and a liquid chamber or the like are formed by etching, for example. When silicon is compared with alumina that is raw material of ceramic with regard to the cost, alumina is generally cheaper than silicon. Thus, according to the printing head 1 of this embodiment, the support base 4 formed by the ceramic sheets 12 can reduce the material cost than in the case of the conventional design.

Figure 11:
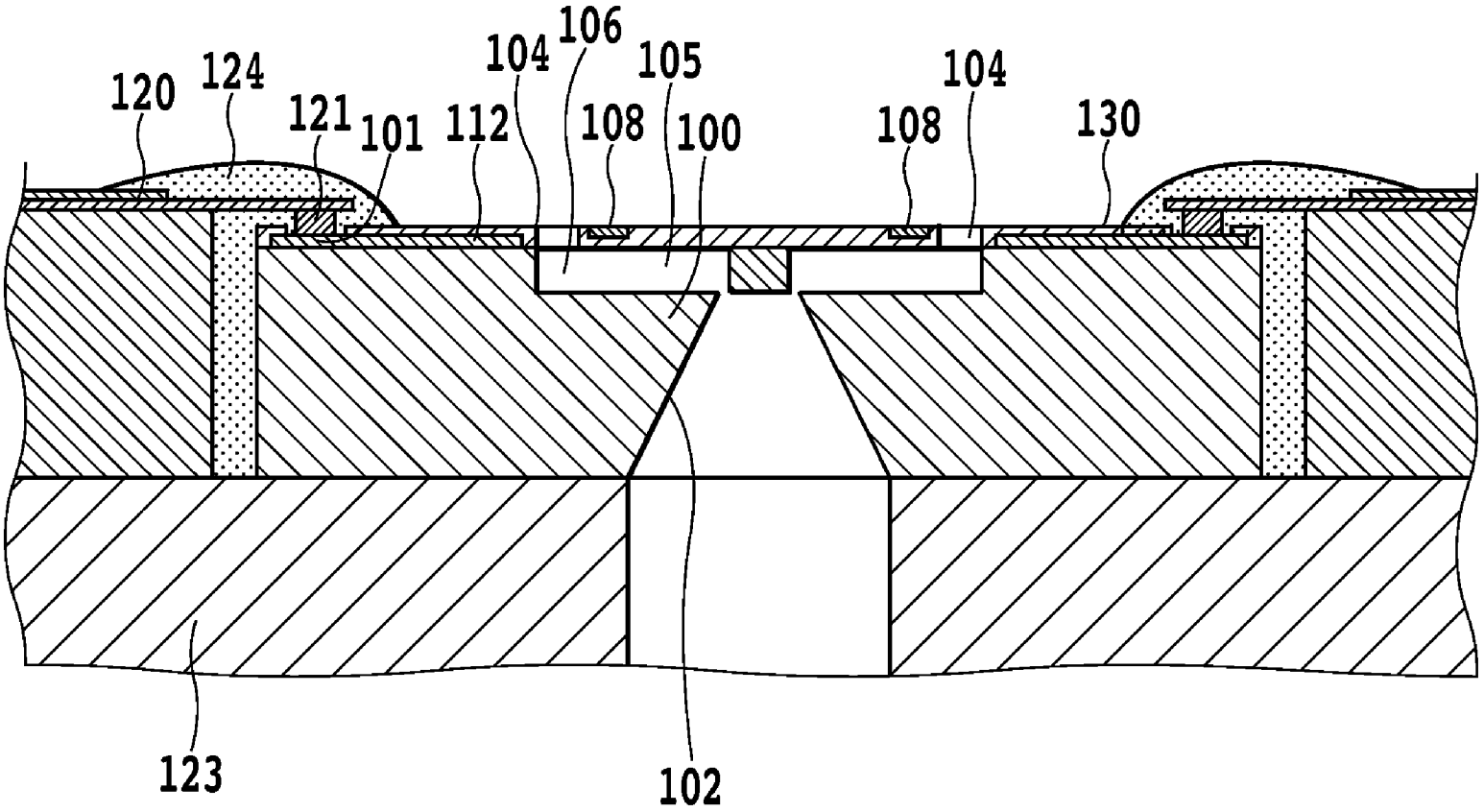
FIG.11 PRIOR ART
FIG. 11 is a cross-sectional view illustrating a conventional back shooting-type printing head.

The support base 4 of this embodiment is formed by adhering a plurality of ceramic sheets 12 (two ceramic sheets 12 in this example) including the ink channel 13 penetrating the ceramic sheets 12 in the thickness direction. Thus, the support base 4 of this embodiment can be manufactured in a manner easier than the manner for manufacturing the conventional printing head shown in FIG. 11.

The printing head 1 is structured by joining the above-described substrate 2, the liquid chamber wall member 3, and the support base 4. These members constitute the liquid chamber 11. As shown in FIG. 1, a part of the back face of the substrate 2 (the lower face) and a part of the surface of the support base 4 (the upper face) constitute the wall face of the liquid chamber 11. Ink introduced by the ink channel 13 to the interior of the liquid chamber 11 is ejected through the ejection port 5 to the upper side in FIG. 1. The connection terminal 17 located on the support base 4 and the electrode 8 located on the back face of the substrate 2 are electrically connected at the back face side of the substrate 2. In this embodiment, a part of the face of the support base 4 joined with the liquid chamber wall member 3 defines the liquid chamber 11.

The connection terminal 17 is electrically connected to the electrode 8 via a gold bump 18. These connection portions 19 are covered by sealant 20. This sealant 20 securely maintains the adhesion state of the substrate 2, the liquid chamber wall member 3, and the support base 4. In this embodiment, this connection portion 19 is formed at the back face of the substrate 2.

In this embodiment, the printing head 1 is manufactured in the following manner. First, the heater 7 and the electrode 8 are formed at the back face of the substrate 2 by a general wiring technique (e.g., photolithography). Specifically, photoresist is previously coated on the substrate 2. Then, the surface coated by the photoresist of the substrate 2 is exposed to light via a mask corresponding to the shapes of the heater 7 and the electrode 8 to form the heater 7 and the electrode 8. Then, the heater 7 and the electrode 8 are covered by a protection layer 22 as shown in FIG. 3.

Then, the substrate 2, in which the heater 7 and the electrode 8 are formed in this manner, is joined with the liquid chamber wall member 3 having a plate-like shape in which the ink supply port 9 and ink flow path 10 are not yet formed. The liquid chamber wall member 3 is made of epoxy resin or the like that cures when being exposed to light. The liquid chamber wall member 3 having a plate-like shape in which the ink supply port 9 and the ink flow path 10 are not yet formed is exposed via a mask having the shapes of the ink supply port 9 and the ink flow path 10 while the liquid chamber wall member 3 is being joined to the substrate 2. Then, a part not exposed by the mask is removed by etching for example. Through the corrosion of the epoxy resin by the etching, the ink supply port 9 and the ink flow path 10 penetrating only the liquid chamber wall member 3 are formed.

After the above step or in parallel with the step of forming the ink supply port 9 and the ink flow path 10 in the liquid chamber wall member 3, the ejection port 5 is formed in the substrate 2. The ejection port 5 also may be formed by photolithography in which patterning is followed by etching or may be formed by other methods.

As described above, the liquid chamber wall member 3 adhered to the substrate 2 is shaped by photolithography to form therein the ink supply port 9 and the ink flow path 10 having predetermined shapes. Thus, the substrate 2 may be joined to the liquid chamber wall member 3 without such a high positioning accuracy that is required when the substrate 2 and the liquid chamber wall member 3 are joined. When the liquid chamber wall member 3 already including the ink supply port 9 and the ink flow path 10 is joined to the substrate 2, it is required that an alignment is performed with the high positioning accuracy.

Thereafter, the back face of the liquid chamber wall member 3 is joined to the back face of the support base 4 to electrically connect the connection terminal 17 to the electrode 8 via the gold bump 18. Then, the sealant 20 is used to cover the entire connection portion 19 including the connection portion between the connection terminal 17 and the gold bump 18 and the connection portion between the electrode 8 and the gold bump 18.

As described above, in this embodiment, the connection portion 19 is located on the back face side of the substrate 2, and the connection portion 19 connects the electrode 8 at the substrate 2 to the in-support-base wiring 15 at the support base 4 electrically. Thus, the sealant 20 covering the connection portion 19 is arranged so that the sealant 20 does not protrude from the ejection port face 21 including the ejection port 5 toward the obverse face side. Thus, a printing operation can be performed so that the ejection port face 21 of the printing head 1 is closer to the print medium.

The printing head 1 as described above allows, when a printing operation is performed, the heater 7 to be energized while ink is stored in the interior of the liquid chamber 11 in the printing head 1. The electric energy is converted to thermal energy to generate heat at the surface of the heater 7, thereby causing ink on the heater 7 to have an increased temperature. When the ink temperature exceeds the boiling point of the ink, bubbles are generated to grow in the direction to the lower side in FIG. 1. The growth of bubbles as described above causes the ink at the periphery of the ejection port 5 to be extruded from the ejection port 5 to the upper side in FIG. 1 (a direction opposed to the print medium). In this manner, ink is ejected in a direction opposite to a direction along which bubbles grow, thereby performing the printing operation.

According to the printing head 1 of this embodiment, a printing operation can be carried out while reducing the distance between the ejection port face 21 and the print medium, thus improving the ink ejection accuracy. Thus, the resultant printed image can have a higher quality.

According to the printing head 1 of this embodiment, the ink channel 13 is formed to penetrate the ceramic sheet 12, and the ink supply port 9 and the ink flow path 10 are formed so as to penetrate the liquid chamber wall member 3, respectively. Thus, the processing for forming these spaces can be easier than the processing shown in FIG. 11 for forming the conventional back shooting-type printing head. Thus, the printing head 1 of this embodiment can reduce manufacture cost. Furthermore, the time required for manufacturing the printing head 1 can be reduced.

Although this embodiment has used the gold bump 18 in order to electrically connect the connection terminal 17 to the electrode 8, the present invention is not limited to this. Other connection methods also may be used so long as the electrical connection between the connection terminal 17 and the electrode 8 is achieved at the back face of the substrate 2. Alternatively, the in-support-base wiring 15 in the via hole also may be directly connected to the electrode 8.

Second Embodiment

Next, the second embodiment according to the present invention will be described with reference to the drawings (FIG. 6 to FIG. 10).

A printing head 1' of the second embodiment according to the present invention (see FIG. 10) is different from the above-described printing head 1 in the first embodiment in that a liquid chamber wall member 3' is made of ceramic.

In this embodiment, since the liquid chamber wall member 3' is made of ceramic, the liquid chamber wall member 3' already including the ink supply port 9 and the ink flow path 10 may be attached to the substrate 2 to subsequently attach the substrate 2 to the support base 4. Alternatively, the liquid chamber wall member 3' already including the ink supply port 9 and the ink flow path 10 also may be attached to the support base 4 to subsequently attach the support base 4 to the substrate 2. In the printing head 1' of this embodiment, the liquid chamber wall member 3' made of ceramic can realize a cheaper material cost than that of epoxy resin that cures when being exposed to light, thereby proportionally reducing the manufacture cost.

Figure 6:
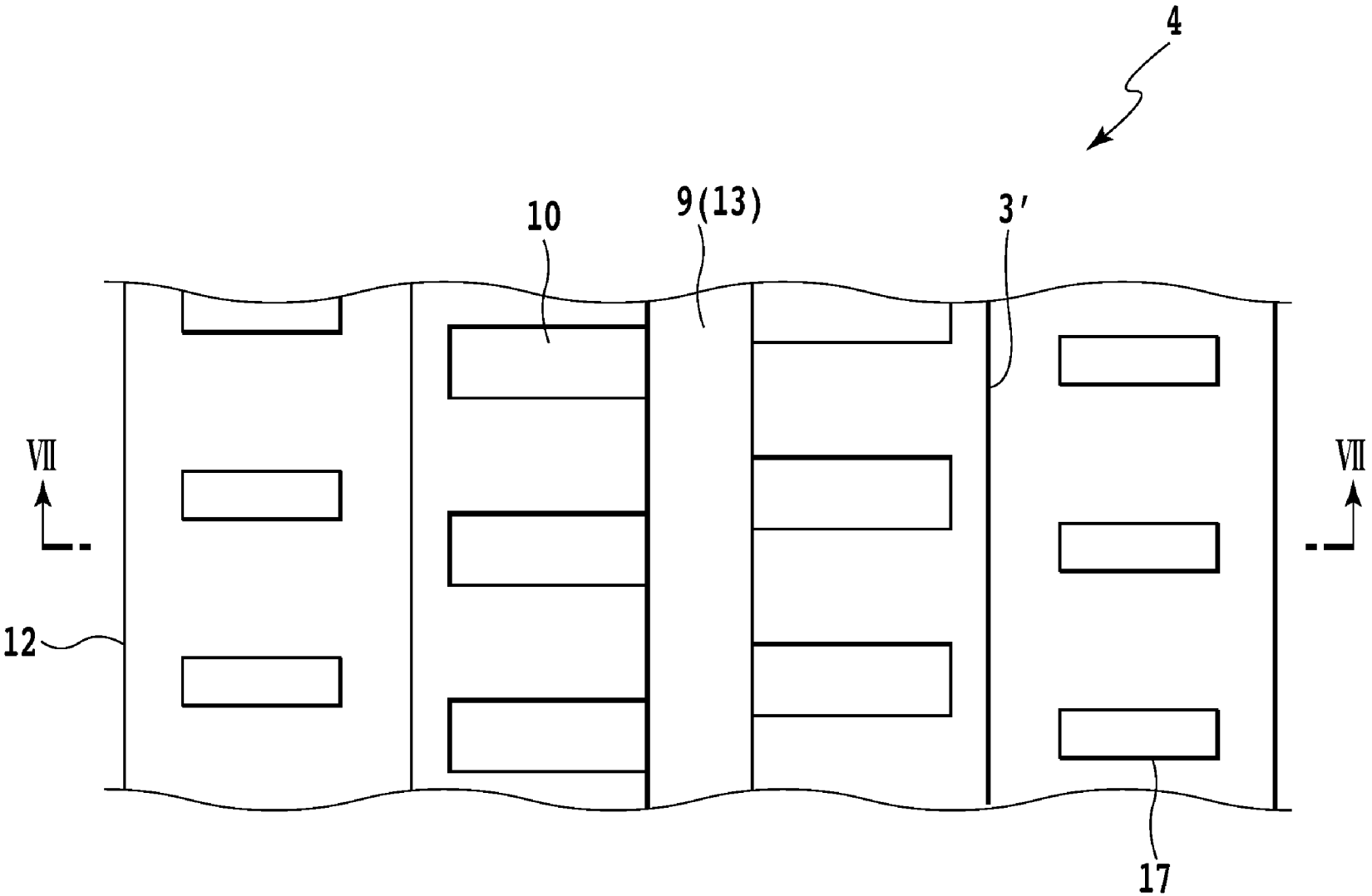
FIG. 6 is a plain view illustrating a liquid chamber wall member and a support base of a printing head in the second embodiment of the present invention seen from the print medium side.
Figure 7:
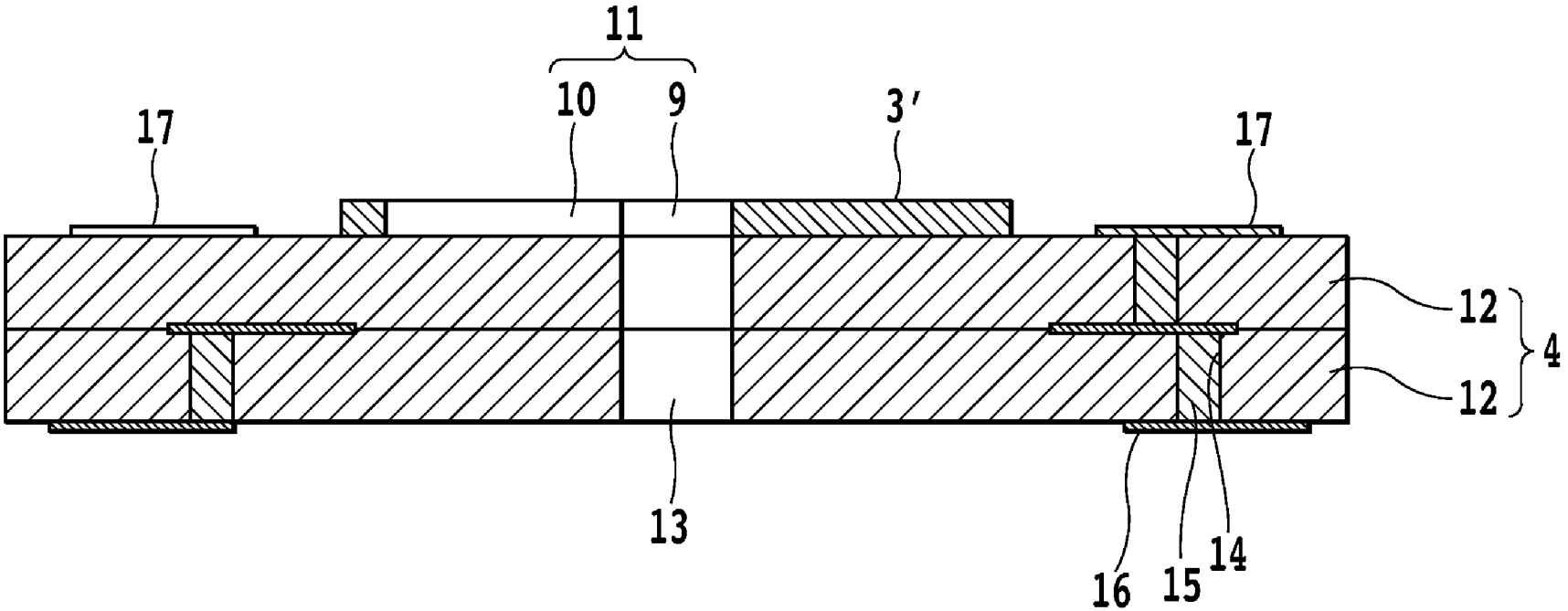
FIG. 7 is a cross-sectional view taken along the line VII-VII of FIG. 6.
Figure 8:
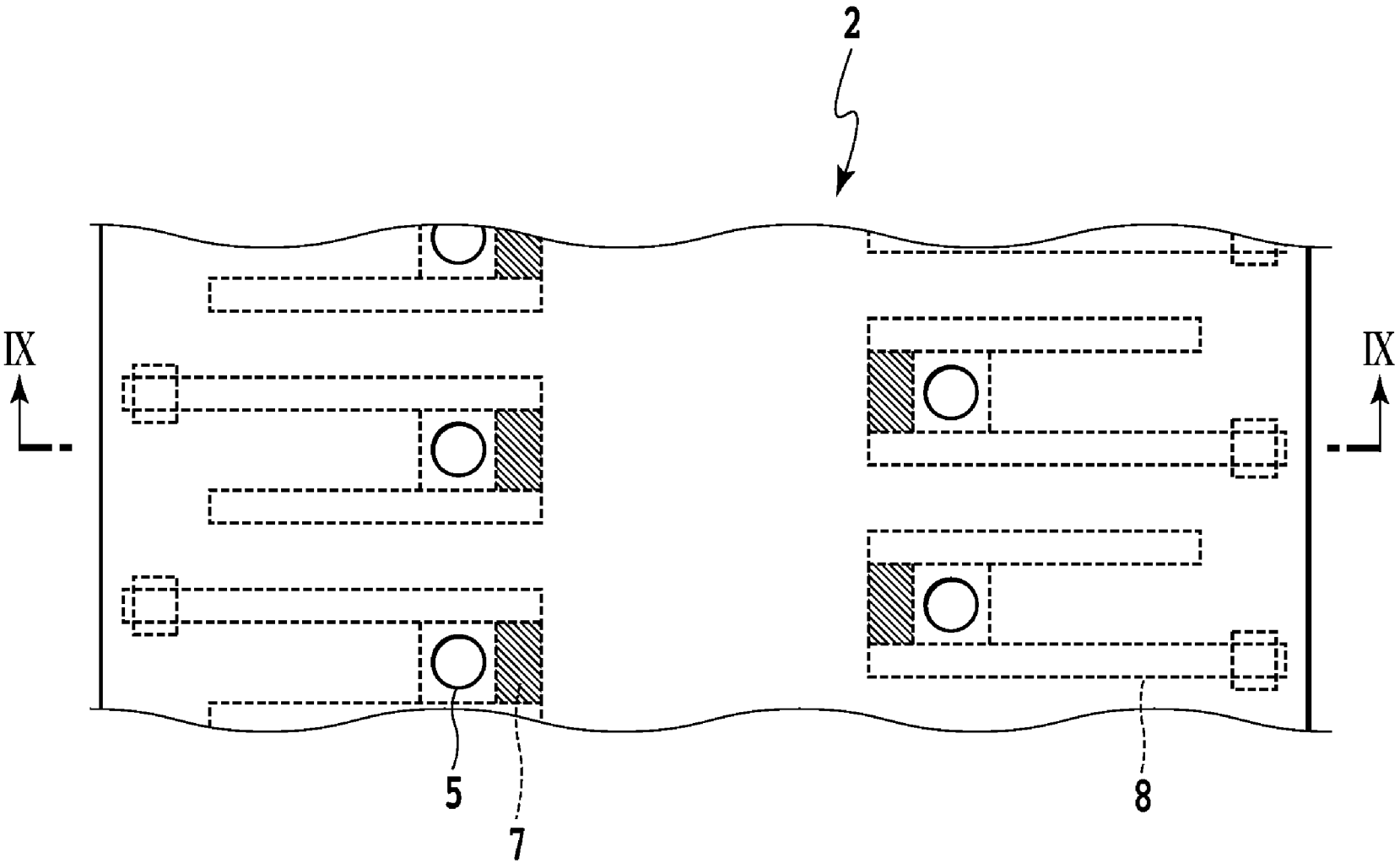
FIG. 8 is a plain view illustrating a substrate of the printing head in the second embodiment of the present invention.
Figure 9:
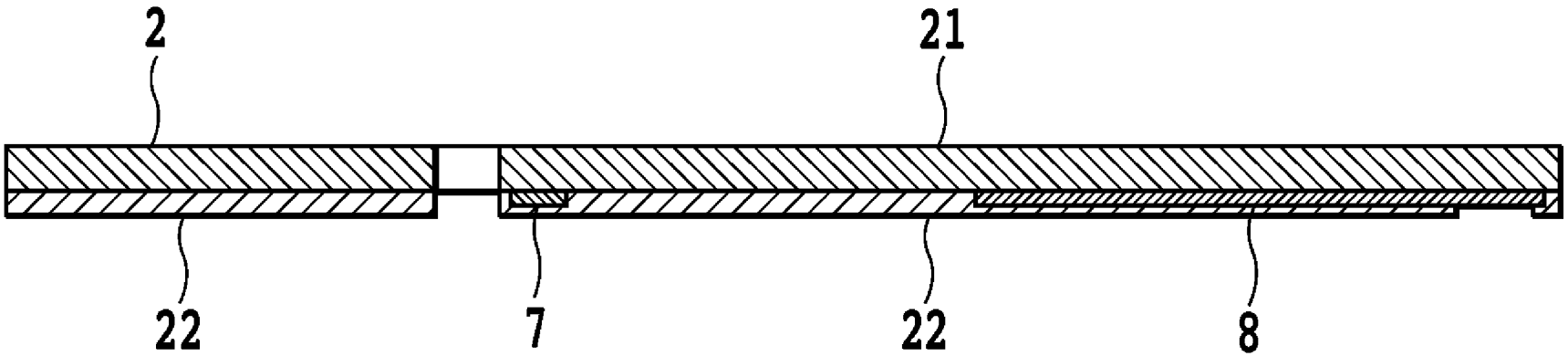
FIG. 9 is a cross-sectional view taken along the line IX-IX of FIG. 8.
Figure 10:
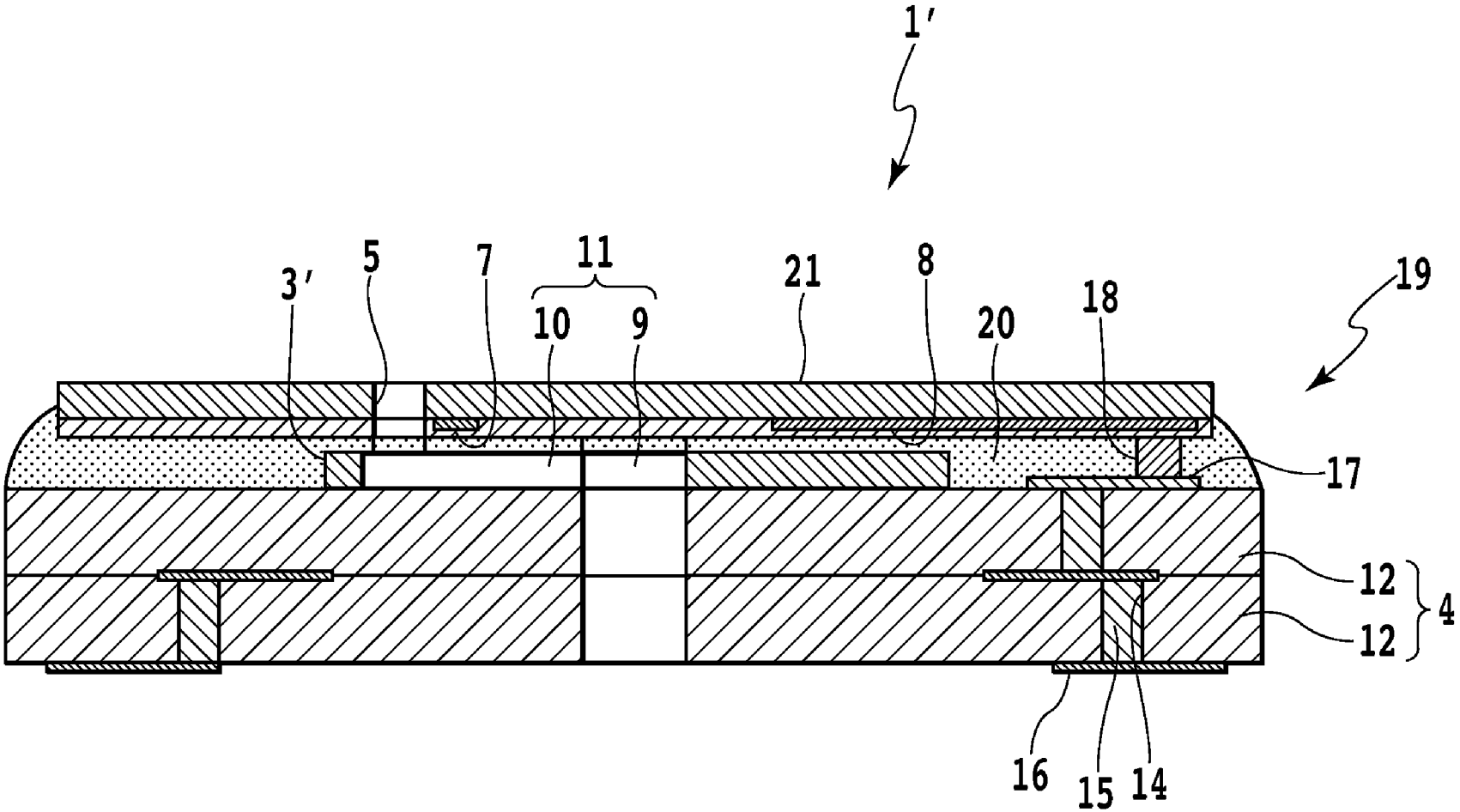
FIG. 10 is a cross-sectional view illustrating the entire printing head in the second embodiment of the present invention.

The printing head 1' in this example is manufactured in the following manner. First, the liquid chamber wall member 3' already including the ink supply port 9 and the ink flow path 10 is joined to the support base 4 as shown in FIG. 6. FIG. 7 is a cross-sectional view taken along the line VII-VII in FIG. 6. Then, the support base 4 attached with the liquid chamber wall member 3' is joined to the substrate 2 shown in FIG. 8. FIG. 9 is a cross-sectional view taken along the line IX-IX in FIG. 8. In this manner, the support base 4 joined with the liquid chamber wall member 3' is joined to the substrate 2, thus achieving the assembly of the printing head 1'. FIG. 10 is a cross-sectional view illustrating the entire printing head in the second embodiment. The other manufacturing steps are the same as those of the first embodiment. The structures other than that of the liquid chamber wall member 3' are also the same as those of the first embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-159293, filed Jun. 15, 2007, which is hereby incorporated by reference herein in its entirety.

What is claimed is:

1. An ink jet printing head comprising:

a silicon substrate including an obverse face and a back face;

an ejection port that ejects liquid and penetrating from the obverse face to the back face;

an electrothermal transducing element configured to generate thermal energy used to eject liquid through the ejection port, the electrothermal transducing element being provided on the back face side;

a conductive line connected to the electrothermal transducing element and provided on the back face;

a support base supporting the silicon substrate from the back face side;

an electrical portion to transmit electricity for driving the electrothermal transducing element, the electrical portion being provided on the support base and connected to the conductive line at the back face of the silicon substrate;

a bump located between the silicon substrate and the support base, the bump contacting the conductive line and the electrical portion, the conductive line and the electrical portion being connected electrically;

a liquid chamber wall member located between the silicon substrate and the support base and including therein a liquid chamber adapted to store liquid to be supplied to the ejection port, the liquid chamber communicating with the ejection port; and a sealant covering the conductive line, the electrical portion and the bump, at outside of the chamber.

2. The ink jet printing head according to claim 1, wherein the support base includes a via hole defined therein, and wherein the electrical portion is arranged in the via hole.

3. The ink jet printing head according to claim 1, wherein the liquid chamber wall member is made of a material that cures when exposed to light.

4. The ink jet printing head according to claim 1, wherein the liquid chamber wall member is made of ceramic.

5. The ink jet printing head according to claim 1, wherein the liquid is ejected through the ejection port along a direction from the back face side of the silicon substrate to the obverse face side of the silicon substrate.

6. The ink jet printing head according to claim 1, wherein the obverse face of the silicon substrate is flat.

7. The ink jet printing head according to claim 2, wherein the support base is formed by a plurality of ceramic sheets and the via hole is formed so as to penetrate the ceramic sheet in the thickness direction.

* * * * *